US006904980B2

(12) United States Patent
Rubie

(10) Patent No.: US 6,904,980 B2
(45) Date of Patent: Jun. 14, 2005

(54) LINERBOLT REMOVAL TOOL

(75) Inventor: Peter John Rubie, Toowoomba (AU)

(73) Assignee: RME Holdings Pty Limited, Milsons Point (AU)

( * ) Notice: Subject to any disclaimer, the term of this patent is extended or adjusted under 35 U.S.C. 154(b) by 0 days.

(21) Appl. No.: 10/474,400

(22) PCT Filed: Apr. 9, 2002

(86) PCT No.: PCT/AU02/00447

§ 371 (c)(1),
(2), (4) Date: Mar. 12, 2004

(87) PCT Pub. No.: WO02/081152

PCT Pub. Date: Oct. 17, 2002

(65) Prior Publication Data

US 2004/0140113 A1 Jul. 22, 2004

(30) Foreign Application Priority Data

Apr. 9, 2001 (AU) ..... PR4302

(51) Int. Cl.[7] ..... B25D 9/02

(52) U.S. Cl. ..... 173/208; 173/206; 173/128; 173/212

(58) Field of Search ..... 173/13, 91, 128, 173/206, 207, 208

(56) References Cited

U.S. PATENT DOCUMENTS 3,739,863 A * 6/1973 Wohlwend ..... 173/204
4,231,434 A * 11/1980 Justus ..... 173/204
4,466,493 A * 8/1984 Wohlwend ..... 173/19
4,479,551 A * 10/1984 Justus ..... 173/204
4,552,227 A * 11/1985 Wohlwend ..... 173/15
4,563,938 A * 1/1986 Henriksson ..... 91/25
4,858,702 A * 8/1989 Piras ..... 173/208
5,129,466 A * 7/1992 Bartels et al. ..... 173/13
5,520,254 A * 5/1996 Weber ..... 173/128
5,806,610 A * 9/1998 Sapozhnikov ..... 173/206

FOREIGN PATENT DOCUMENTS

| | | |
|---|---|---|
| AU | 9726116 | 7/1997 |
| DE | 4200574 | 7/1993 |
| GB | 9938655 | 8/1999 |

* cited by examiner

*Primary Examiner*—Scott A. Smith
(74) *Attorney, Agent, or Firm*—Hedman & Costigan, P.C.

(57) ABSTRACT

A pneumatic linerbolt removing tool including a moil supported for reciprocal movement along a hammer axis within a housing, an inertial body movably mounted along the hammer axis, and a piston assembly moveable within the inertial body along the hammer axis between a striking position at which it strikes the moil and a retracted position remote therefrom. The tool further including a gas-charged accumulator for urging the piston toward the moil and air supply to a cylinder adapted to urge a biasing piston on the inertial body relative to the housing and toward the moil. The inertial body being ported so that working air is supplied to a front face of the piston assembly to urge it to a coked position away from the moil and whereby the accumulator is in its compressed state, and selectively operable porting for equalizing pressure between the front and rear faces of the piston, to continuously allow transfer of air between the faces while in operation.

15 Claims, 5 Drawing Sheets

LINERBOLT REMOVAL TOOL

TECHNICAL FIELD

This invention relates to a linerbolt removing tool.

BACKGROUND OF THE INVENTION

A typical application of the present invention is in the removal of bolts from mining equipment, such as mills that utilise sacrificial segmented liners bolted to the internal casing of the mills which are regularly replaced during routine maintenance. Typically such mills may range in size from three meter to eleven meter in diameter and are lined with replaceable heavy steel segments attached internally to the mill casing by through bolting. In such applications the bolts become corroded and clearances between bolts and holes become compacted with ore fines. This results in difficult bolt removal at liner removal time. As a result the many bolts that are utilised to attach the liners to the mill shell: are often required to be freed manually by the use of large sledge-hammers. This is a difficult and time-consuming task that may result in injury to the workers.

While it is well known to use percussive devices such as jack-hammers and hydraulically powered hammers to provide repetitive impacts for many applications, they are not able to be manually guided into alignment with wall mounted bolts and other components. The applications of jack hammers are limited as the hammering effect produced by an electrically or pneumatically operated jack hammer does not provide the impact as would be provided by a sledge hammer, for example.

In known hammering devices capable of delivering such impacts, a high reaction force is produced which necessitates that such devices be carried by articulating machines or be rigidly attached to some support structure. This reduces their versatility and makes them unsuitable for many applications. Furthermore, it is difficult to quickly and accurately align such devices with the shank of a bolt or the like for effecting ready removal thereof.

International publication WO97/26116 by the present applicant describes a hydraulic linerbolt removal tool. The hydraulic tool essentially comprises a housing having a moil mounted at the forward end and a hydraulic piston assembly reciprocally moveable along the hammer axis between a striking position at which the piston assembly strikes the impact delivery member and a retracted position remote from the impact delivery member. A firing means is provided for hydraulically firing the piston assembly from its retracted position to its striking position under the control of actuating means. A reactive body assembly is moveable in the direction of the hammer axis by driving means towards the impact delivery member prior to operation of the firing means whereby the reactive body assembly may be energised by movement and subsequently decelerated to substantially absorb the reaction generated by firing the piston assembly. Recoil is thus reduced whereby the apparatus may be operated by hand with the apparatus being suspended about its centre of gravity at the work site.

This hydraulic apparatus requires a 2400 psi hydraulic supply. The apparatus also requires electronic control for timing purposes. The present applicant has determined that there is a need for linerbolt removing tools that are operable from a conventional compressed air supply.

SUMMARY OF INVENTION

With the foregoing in view, this invention in one aspect resides broadly in a pneumatically actuated linerbolt removing tool including:

a housing;

a moil supported for reciprocal movement along a hammer axis by the housing;

an inertial body mounted for reciprocating movement in said housing along said hammer axis;

a piston assembly moveable within said inertial body along the hammer axis between a striking position at which the piston assembly strikes the moil and a retracted position remote from the moil, a gas-charged accumulator adjacent said piston assembly and tending to urge said piston toward said moil;

working air supply means to a cylinder associated with said housing and adapted to urge a biasing piston on said inertial body relative to the housing and toward said moil, said inertial body being ported whereby said working air is supplied to a front face of said piston assembly to urge the piston assembly to a cocked position away from said moil and whereby said accumulator is in its compressed state; and selectively operable porting means adapted to equalize pressure between said front face and a rear face of said piston whereby said piston accelerates forward under accumulator force to strike said moll while said inertial body accelerates away from said moil, said porting means being adapted to continuously allow transfer of air between said faces while in operation.

The moil is preferably constrained to move over a selected distance along the axis. The moil may be biased toward its rearward retracted position with the tool at rest.

The inertial body is preferably constrained to move along one or more guides associated with the housing. The cylinder associated with the body and receiving the supply air may cooperate with the biasing piston associated with the inertial body to provide at least a portion of this guidance.

The accumulator may be formed as a substantially blind axial cylinder formed in the inertial body. There may be provided an integrally formed or assembled rearward piston portion adapted to close the open face of the accumulator bore. The accumulator may be gas charged external of the housing via a suitably valved charging tube to the inertial body which may include a flexible tube section to accommodate movement of the inertial body.

The means for providing working air to the front face of the piston assembly is preferably via a passage from through the biasing piston to an annular space which may port through a plurality of ports in the forward peripheral wall of the bore in which the piston assembly slides in the inertial body. By this means the pressure applied to the front face may remain constant while the air supply is connected, and the annular space may then accommodate a sleeve-type porting closure adapted to selectively open and close corresponding ports arranged about the periphery of the other end of the bore to equalize pressure on both faces of the piston assembly.

The preferred porting closure is preferably adapted to have a closely conformed sealing surface at each of its forward and rearward extents and the rearward sealing surface is adapted to selectively occlude and open the rearward ports by axial movement of the closure on a corresponding sealing surface on the inertial body. Between the forward and rearward sealing surfaces of the closure, there is preferably provided an annular space having a working surface and adapted to be supplied with a switchable air supply. The annular space may be divided into a pressurizable space controlled by said switchable air supply and a vented space.

On switching of the air supply to the pressurizable space, the porting closure moves forward to open the rearward ports thus allowing equalizing pressure to pass to the rear face of the piston assembly. There may be provided an overlapping vent between the rearward ports and the vented space and adapted, to be closed by the closure before the rearward ports are opened.

On equalization on both sides of the piston, the accumulator urges the piston into impact with the moil, reaction forces being borne by the relatively massive inertial body and thus isolated from the housing at the time of impact to be dissipated over the relaxation time of the heavier body.

When the switchable air is turned off, the static pressure of the air supply returns the components to their original positions.

DESCRIPTION OF DRAWINGS

In order that this invention may be more readily understood and put into practical effect, reference will now be made to the accompanying drawings which illustrate a typical embodiment of the invention and wherein.

DESCRIPTION OF THE PREFERRED EMBODIMENT

Figure 1:
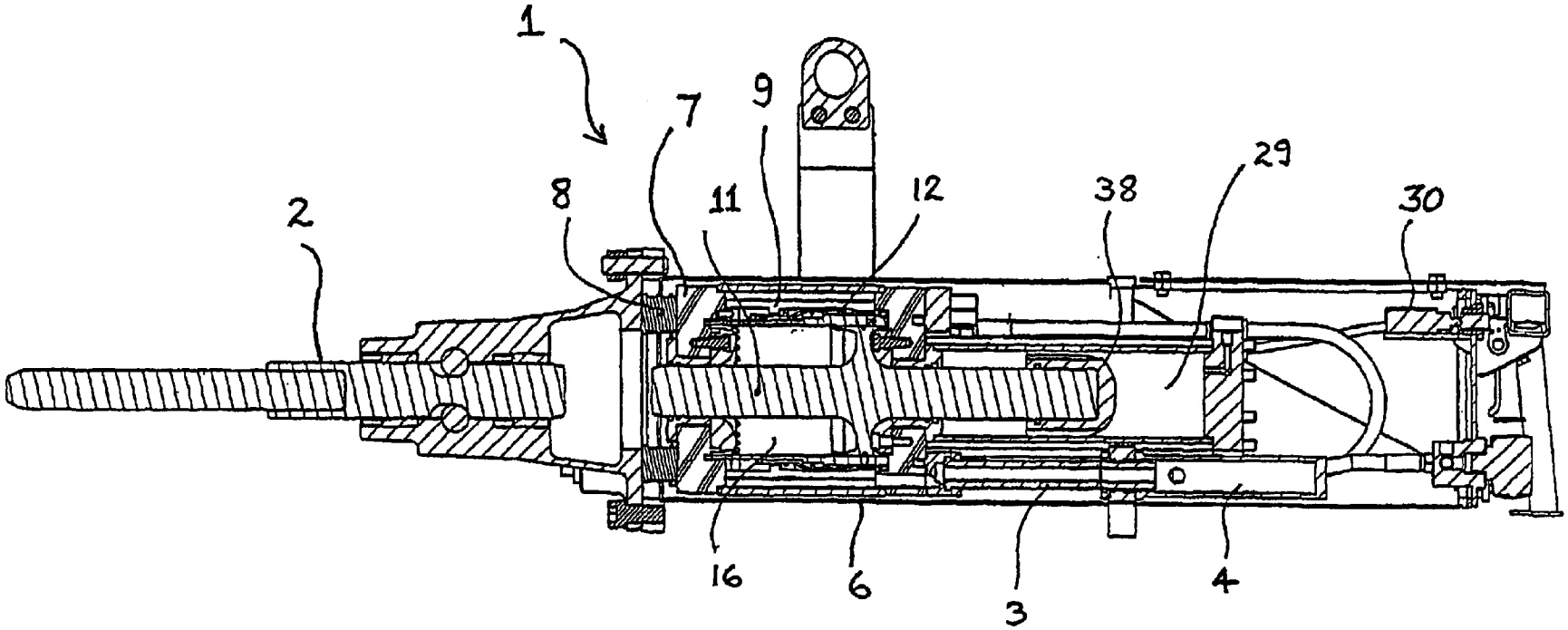
FIG. 1 is a longitudinal sectional view of a tool of the present invention.

FIGS. 1 to 5 depicts a linerbolt removing tool 1 adapted to be suspended by a length adjustable sling (not shown) supported about its centre of gravity by a mounted overhead carriage (not shown), in a similar manner to the prior art tool disclosed in International Patent Publication No. WO97/26116. Tool 1, in a similar manner to the prior art tool, is readily pivoted about horizontal and vertical axes to align moil 2 with a bolt (not shown) to be removed from a mill casing (not shown).

An important feature of tool 1, is the operation of hollow tube 3 and cylinder 4 which actuate, hammer body 5. Air is supplied at relatively constant pressure and connected to a large reservoir. This ensures that the force at the end of hollow tube 3 is fairly constant. Cylinder 4 is anchored to the outer case 6, which the operator holds. This means that although large recoil forces are acting upon the hammer body 5 during the firing cycle, the effect on the operator is a constant low force.

Hammer body 5 is mounted within case 6 via four linear bearings on two parallel rails. These allow hammer body 5 to freely move axially. In the forward rest position the face of end plate 7 rests against a rubber/steel buffer 8. Compressed air is delivered to volume 9 of hammer body via port 10. Hollow tube 3 acts as a bias piston inside cylinder 4 which is sealed. Compressed air is supplied to cylinder 4, which in addition to supplying the needs of hammer body 5, exerts a force on the end of hollow tube 3. This force biasedly holds hammer body 5 in the forward position, and when hammer body 5 is fired, decelerates the body and returns it to the forward rest position.

Figure 2:
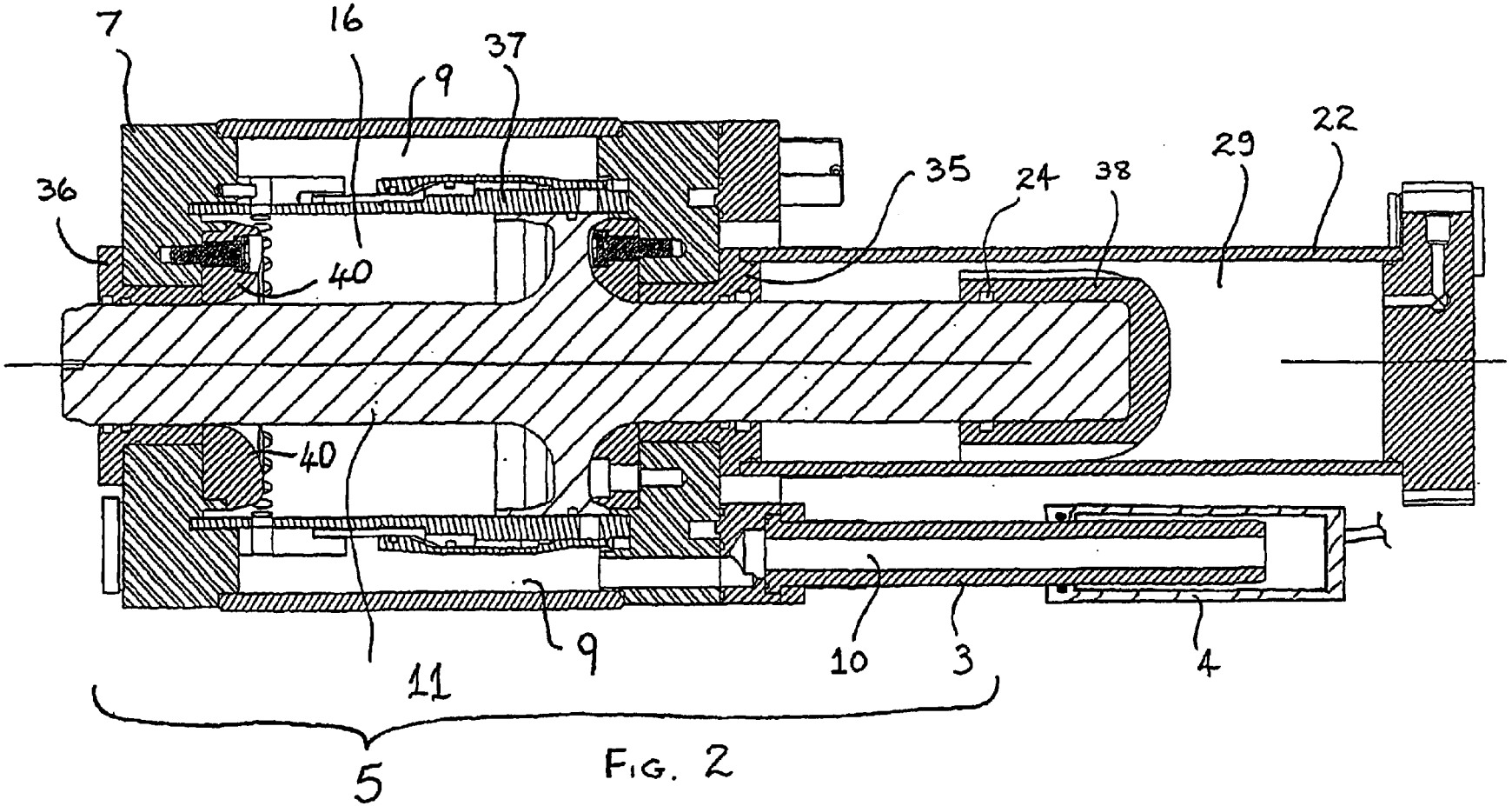
FIGS. 2 and 3 illustrate the hammer mechanism of the apparatus of FIG. 1, in retracted and extended attitudes respectively.
Figure 3:
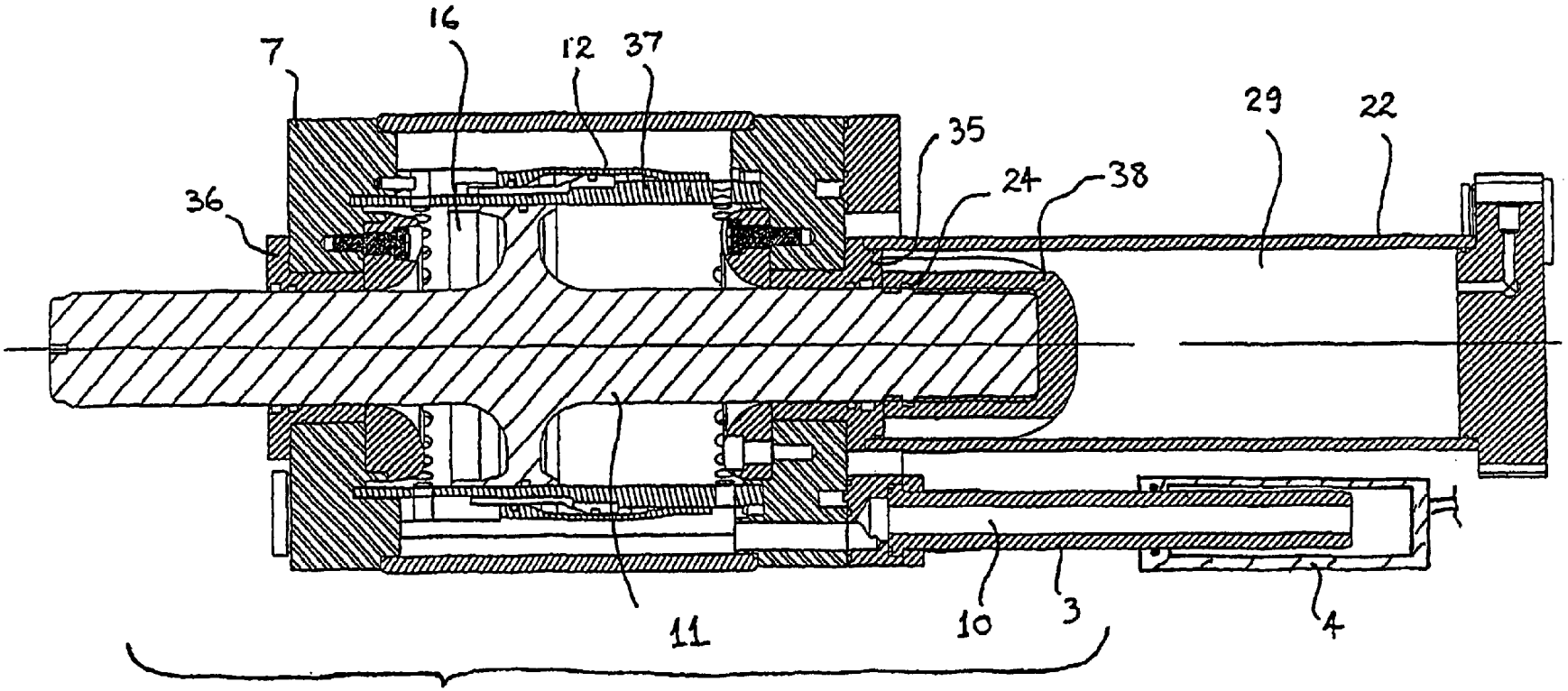
Figure 4:
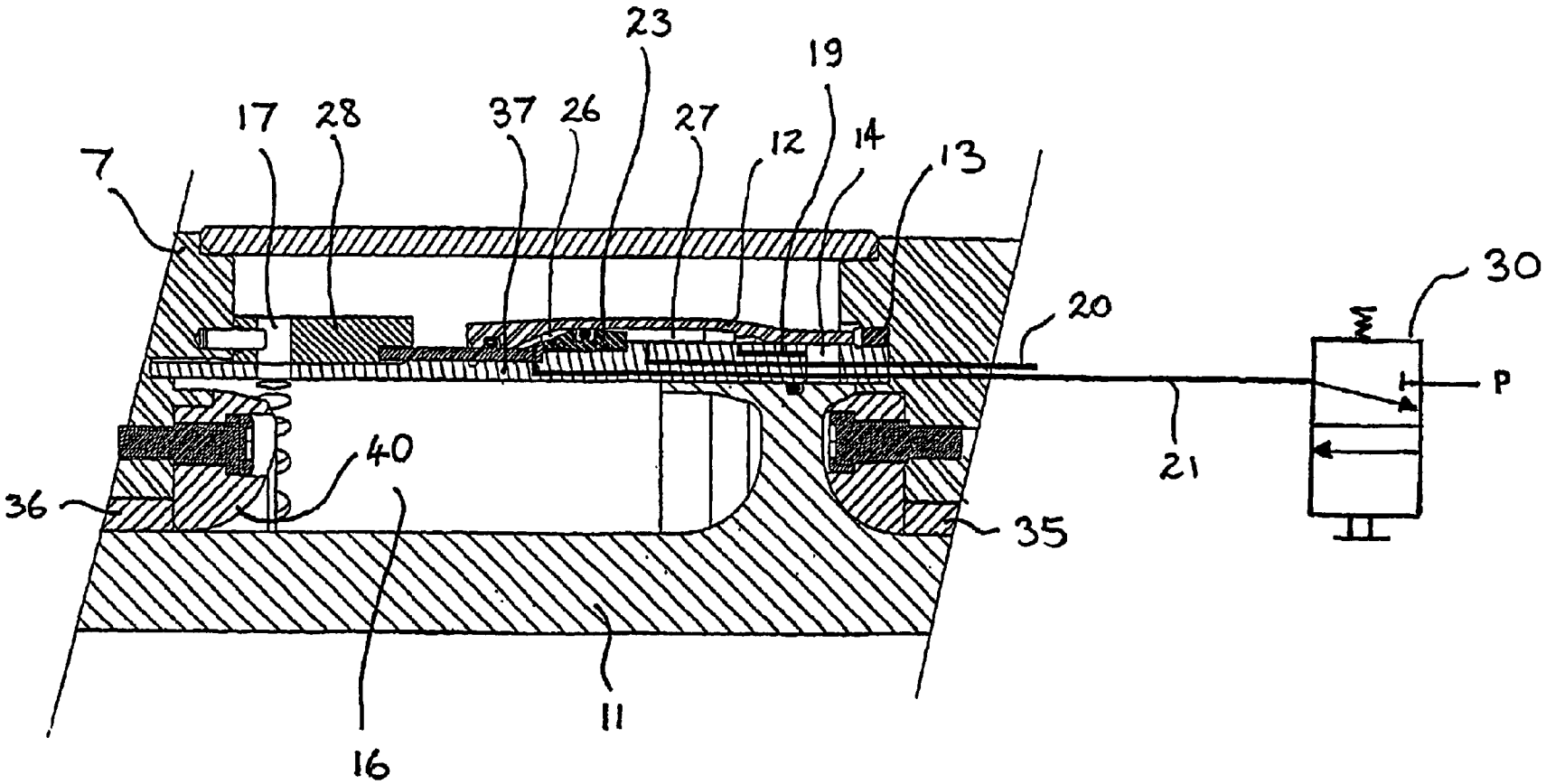
FIG. 4 is a half section of the valve arrangement of the apparatus of FIG. 1, operably closed.
Figure 5:
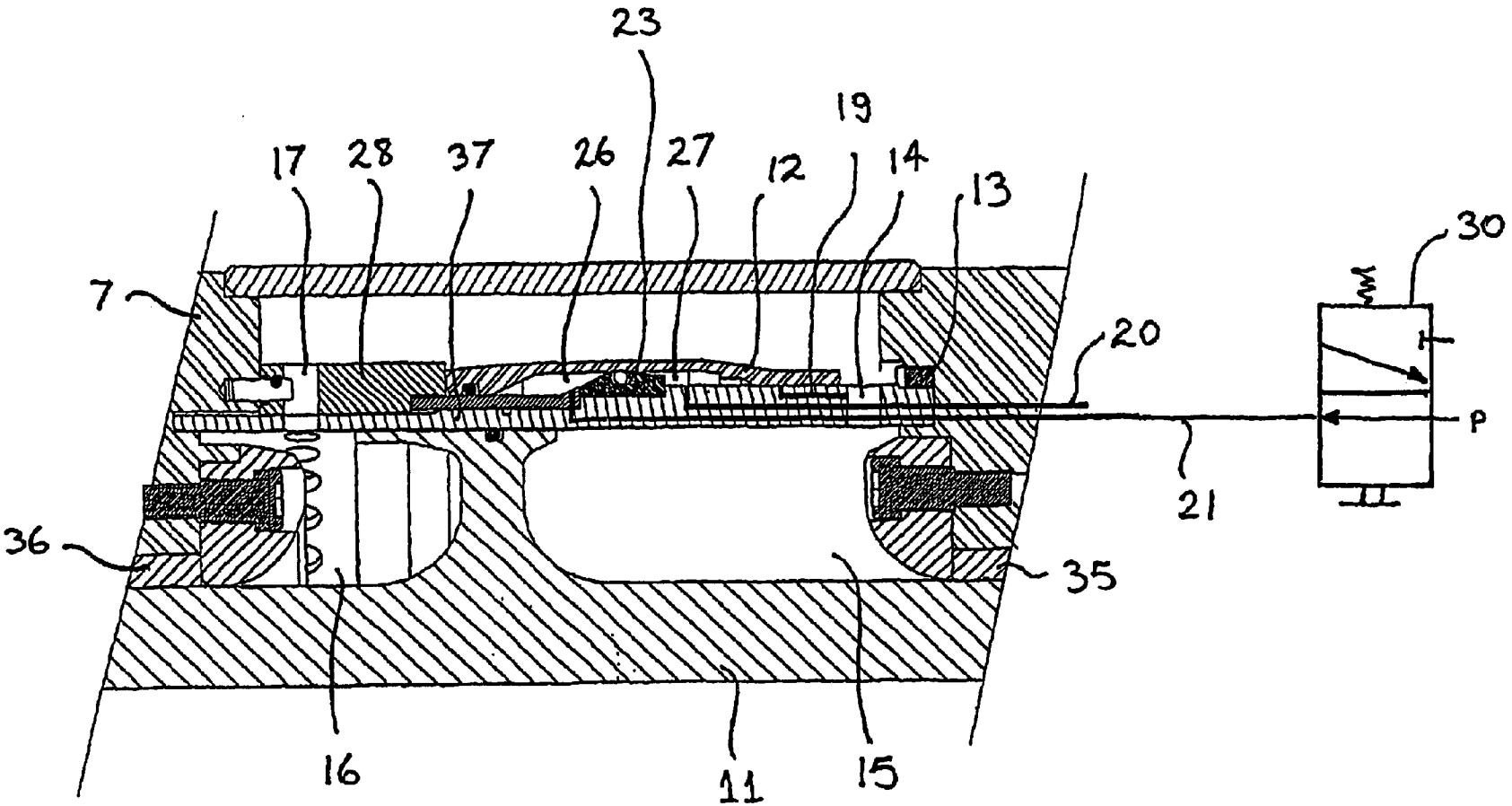
FIG. 5 is a half section of the valve arrangement of the apparatus of FIG. 1, operably open.

The "valve function" will now be described. FIGS. 2 and 4 show hammer body 5 with hammer piston 11 retracted in a charged position. In this state valve sleeve 12 is retracted against buffer 13. A series of radial ports 14 are covered by sleeve 12 preventing pressurised air from volume 9 entering space 15 behind piston 11. The space 16 in front of piston 11 is connected to pressurised volume 9 via a series of radial ports 17. Space 15 behind piston 11 is vented to atmosphere via ports 19 and 20. The differential pressure across piston 11 holds it in the retracted position against the pressure 29 of nitrogen charged accumulator 22.

The pilot line 21 is vented to atmosphere through the trigger valve 30. This places the volume 26 in front of seal ring 23 at atmospheric pressure. Volume 27 behind the seal ring 23 is also vented to atmosphere via port 20. The outside of sleeve 12 is at system pressure. The cross-sectional area of the front of sleeve 12 is greater than the cross-sectional area of the rear of sleeve 12; this results in an unbalanced force keeping the sleeve 12 in the retracted position.

When the operator presses the trigger valve 30 the volume 26 in front of the seal ring 23 is pressurized. This causes valve sleeve 12 to move towards cushion 28 (refer FIGS. 3 and 5). As it moves, port 19 is covered and radial: ports 14 are uncovered. The space 15 behind the piston 11 is no longer vented to atmosphere but is pressurised by the system pressure in volume 9. The pressure across piston 11 is now balanced and the pressure 29 of the nitrogen gas in accumulator 22 acting on the rear of piston 11 accelerates it forward. As piston 11 travels forward, the gas in front of the piston in space 16 vents through radial ports 17 into volume 9, and fills space 15 created by advancing piston 11 via radial ports 14.

When trigger valve 30 is released, sleeve valve 12 retracts covering radial ports 14 and uncovering port 19. This vents space 15 behind piston 11 to atmosphere, causing piston 11 to retract as described above.

The valve operation described above ensures that the pressure drop across piston 11 is minimised during firing; this is due to the fact that large volumes of gas do not need to be vented to atmosphere during the firing cycle.

The firing of piston 11 will now be described. Piston 11 is supported in two bronze glands 35 and 36 and is sealed against sleeve 37 creating the two spaces (volumes) 16 and 15. The rear of piston 11 extends into pressurized accumulator 22. A piston cap 38 is mounted on the rear of piston 11. A seal 24 prevents gas entering the space between piston 11 and piston cap 38.

As piston 11 and piston cap 38 accelerate forward under the force of the accumulator gas pressure 29 acting on the rear of piston cap 38, a point is reached where the piston cap 38 comes into contact with the gland 35. As piston 11 continues to travel forward a vacuum is drawn between the piston cap 38 and piston 11. The piston 11 is now no longer being accelerated by the nitrogen gas filled volume 29 in accumulator 22 but is being retarded slightly by the vacuum. The piston 11 travels at a nearly constant velocity for a short period after the impact of piston cap 38. It is during this period of constant velocity that piston 11 strikes moil 2. This period of constant velocity is necessary as the distance from piston 11 to moil 2 may change from one fire to the next, due to the angle of operation and the other variables. Once piston 11 has struck moil 2 its forward motion is halted and it remains at rest until the trigger valve 30 is released initiating the retraction cycle. If piston 11 was still being acted upon by accumulator pressure 29 at the moment of impacting moil 2, the piston 11 would continue to push on moil 2 after impact and create a variable recoiling force which would be felt by the operator. If for some reason piston 11 does not strike moil 2 during this period of constant velocity, it continues forward until the leading edge of piston 11 begins to cover radial ports 17. The air occupying space 16 then begins to compress decelerating piston 11. The piston 11 will eventually entirely cover radial ports 17 and the enclosed volume will bring piston 11 to a complete rest. The piston buffer 40 is shaped to match the internal profile of piston 11' to ensure that the enclosed volume 16 is minimised during the cushioning process. A larger volume would result in piston 11 not coming to rest before reaching the end of its travel.

The velocity of piston 11 when retracting is considerably less than when it is firing therefore a similar but somewhat smaller cushion is provided at the end of the retraction stroke.

It is to be understood that the above has been given by way of illustrative embodiment of the invention, all such modifications and variations thereto as would be apparent to persons skilled in the art are deemed to fall within the broad scope and ambit of the invention as described herein.

What is claimed is:

1. A pneumatically actuated linerbolt removing tool including:

a housing;

a moil supported for reciprocal movement along a hammer axis by the housing;

an inertial body mounted for reciprocating movement in said housing along said hammer axis;

a piston assembly movable within said inertial body along the hammer axis between a striking position at which the piston assembly strikes the moil and a retracted position remote from the moil;

a gas-charged accumulator adjacent said piston assembly and tending to urge said piston assembly toward said moil;

working air supply means to a cylinder associated with said housing and adapted to urge a biasing piston on said inertial body relative to the housing and toward said moil, said inertial body ported whereby said working air is supplied to a front face of said piston assembly to urge the piston assembly to a cocked position away from said moil and whereby said accumulator is in its compressed state; and selectively operable porting means adapted to equalize pressure between said front face and a rear face of said piston assembly whereby said piston assembly accelerates forward under accumulator force to strike said moil while said inertial body accelerates away from said moil, said porting means being adapted to continuously allow transfer of air between said faces while in operation.

2. The pneumatically actuated linerbolt removing tool as claimed in claim 1, wherein the moil is constrained to move over a selected distance along the hammer axis.

3. The pneumatically actuated linerbolt removing tool as claimed in claim 1, wherein the moil is biased towards the retracted position with the tool at rest.

4. The pneumatically actuated linerbolt removing tool as claimed in claim 1, wherein the inertial body is constrained to move along one or more guides associated with the housing.

5. The pneumatically actuated linerbolt removing tool as claimed in claim 1, wherein the accumulator is formed as a substantially blind axial cylinder formed in the inertial body.

6. The pneumatically actuated linerbolt removing tool as claimed in claim 1, wherein any integrally formed or assembled rearward piston portion is adapted to sealingly close the open face of the accumulator bore.

7. The pneumatically actuated linerbolt removing tool as claimed in claim 1, wherein the accumulator may be gas charged external of the housing via a suitably valved charging tube to the inertial body which may include a flexible tube section to accommodate movement of the inertial body.

8. The pneumatically actuated linerbolt removing tool as claimed in claim 1, wherein the means for providing working air to the front face of the piston assembly is via a passage through the biasing piston to an annular space which may port through a plurality of ports in the forward peripheral wall of the bore in which the piston assembly slides in the inertial body, whereby the pressure applied to the front face may remain constant while the air supply is connected, and the annular space may then accommodate a sleeve-type porting closure adapted to selectively open and close corresponding ports arranged about the periphery of the other end of the bore to equalize pressure on both faces of the piston assembly.

9. The pneumatically actuated linerbolt removing tool as claimed in claim 8, wherein the preferred porting closure is adapted to have a closely conformed sealing surface at each of its forward and rearward extents and the rearward sealing surface is adapted to selectively occlude and open the rearward ports by axial movement of the closure on a corresponding sealing surface on the inertial body.

10. The pneumatically actuated linerbolt removing tool as claimed in claim 9, wherein between the forward and rearward sealing surfaces of the closure, there is provided an annular space having a working surface and adapted to be supplied with a switchable air supply.

11. The pneumatically actuated linerbolt removing tool as claimed in claim 10, wherein the annular space may be divided into a pressurizable space controlled by said switchable air supply and a vented space.

12. The pneumatically actuated linerbolt removing tool as claimed in claim 11, wherein upon switching of the air supply to the pressurizable space, the porting closure moves forward to open the rearward ports thus allowing equalizing pressure to pass to the rear face of the piston assembly.

13. The pneumatically actuated linerbolt removing tool as claimed in claim 12, wherein an overlapping vent is located between the rearward ports and the vented space and adapted to be closed by the closure before the rearward ports are opened.

14. The pneumatically actuated linerbolt removing tool as claimed in claim 13, wherein upon equalization on both sides of the piston, the accumulator urges the piston into impact with the moil, reaction forces being borne by the relatively massive inertial body and thus isolated from the housing at the time of impact to be dissipated over the relaxation time of the heavier body.

15. The pneumatically actuated linerbolt removing tool as claimed in claim 14, wherein when the switchable air is turned off, the static pressure of the air supply returns the components to their original positions.

* * * * *